US006860395B2

(12) United States Patent
Gallego

(10) Patent No.: US 6,860,395 B2
(45) Date of Patent: Mar. 1, 2005

(54) SYSTEM AND ADDING HYDRAULIC FLUID TO THE BALANCING LINE OF A JIB OF A LEVEL LUFFING CRANE

(75) Inventor: Antoine Gallego, Saint Laurent de la Salanque (FR)

(73) Assignee: S.M.S. Synergie Management Systeme, Perpignan (FR)

( * ) Notice: Subject to any disclaimer, the term of this patent is extended or adjusted under 35 U.S.C. 154(b) by 147 days.

(21) Appl. No.: 10/397,387

(22) Filed: Mar. 27, 2003

(65) Prior Publication Data

US 2003/0192849 A1 Oct. 16, 2003

(30) Foreign Application Priority Data

Mar. 28, 2002 (FR) ..... 02 03879

(51) Int. Cl.[7] ..... B66C 23/76
(52) U.S. Cl. ..... 212/279; 212/196
(58) Field of Search ..... 212/279, 196; 414/708

(56) References Cited

U.S. PATENT DOCUMENTS 4,205,308 A * 5/1980 Haley et al. ..... 340/685
4,773,814 A * 9/1988 Brocklebank et al. ... 414/695.5
4,867,321 A * 9/1989 Montgon ..... 212/196
6,102,220 A * 8/2000 Becker ..... 212/196
6,647,718 B2 * 11/2003 Stephenson ..... 60/403

FOREIGN PATENT DOCUMENTS

| | | |
|---|---|---|
| EP | 0 033 060 | 8/1981 |
| FR | 1 135 807 | 5/1957 |
| GB | 1110475 | 4/1968 |
| WO | WO 98/55289 | 12/1998 |

* cited by examiner

*Primary Examiner*—Thomas J. Brahan
(74) *Attorney, Agent, or Firm*—Young & Thompson

(57) ABSTRACT

A fluid supply line 13 connects the hydraulic fluid supply pump 11 to the hydraulic balancing pipe 9, and this line 13 is fitted with a solenoid valve 15. Position detectors 17, 18 are installed on the auxiliary arm 4 and on the main arm 3 close to the articulation of the counterweight balancing beam 5. If the main arm 4 is detected to be in its pendular position before the counterweight balancing beam 5 is detected to be in its vertical position, the logic controller 16 controls activation of the solenoid valve 15 in order to add hydraulic fluid to the jack 8 in order to bring the balancing beam 5 in vertical position.

9 Claims, 3 Drawing Sheets

SYSTEM AND ADDING HYDRAULIC FLUID TO THE BALANCING LINE OF A JIB OF A LEVEL LUFFING CRANE

FIELD OF THE INVENTION

The present invention relates to devices for automatic balancing of the jib of a crane with articulated or telescopic arms as a function of the variation in the span of this jib, and more particularly such as an automatic balancing device with hydraulic control.

BACKGROUND OF THE INVENTION

French Patent No. 82.19842 (2 536 733) describes an automatic hydraulic balancing device for the jib of a crane in which a hydraulic jack chamber controlling the movement of the auxiliary arm of the jib and a chamber of the hydraulic jack controlling the counterweight balancing beam are connected together in series, while the other chamber of each of the two jacks is selectively connected using a hydraulic distributor either to a hydraulic fluid supply source, or to a hydraulic fluid reservoir. The result is that fluid is transferred into the balancing line between the two jacks, causing automatic balancing of the jib by proportional displacements of the centres of gravity of the auxiliary arm and the counterweight.

This known device enjoys deserved success, however, it does have the disadvantage that due to leaks that occur in hydraulic circuits, particularly at seals, there may be a lack of synchronisation in the movements of the auxiliary arm and the counterweight balancing beam which can disturb operation of the device.

SUMMARY OF THE INVENTION

The purpose of this invention is to correct this disadvantage and consequently it proposes a simple, reliable and inexpensive system for automatically or manually compensating this lack of synchronisation.

According to the invention, a jib of a level luffing crane with a hydraulic balancing device is of the type comprising a main arm installed free to rotate about a support turret, an auxiliary arm articulated at one end of the main arm and which tilts under the control of a first double acting hydraulic jack supported on the main arm and the rod of which is connected to the auxiliary arm, a counterweight articulated at the rear end of the main arm, a second double acting hydraulic jack supported on the main arm with its rod coupled to the counterweight, a hydraulic balancing pipe connecting the annular chambers of the said first and second jacks together, and a control device selectively connecting the full section chamber of the first or the second hydraulic jack to a hydraulic fluid supply source and the full section chamber of the other of the two said hydraulic jacks to a hydraulic fluid reservoir. It is characterised by a hydraulic fluid transfer line connecting the hydraulic fluid supply source to the hydraulic balancing pipe, a means for controlling the fluid input into the balancing pipe being provided on the said fluid supply line.

According to one automatic control embodiment of the invention, the fluid inlet control means is composed of a solenoid valve, and position detection means are placed firstly close to the articulated link between the main arm and the auxiliary arm, and secondly close to the articulated connection between the main arm and the counterweight. If a pendular position of the auxiliary arm is detected and a pendular position of the counterweight is not detected at the same time, these position detection means control activation of the solenoid valve through a logic controller in order to add hydraulic fluid to the balancing pipe.

Thus, it can be understood that if there is lack of synchronisation in the movements of the auxiliary arm and the counterweight, in other words when the auxiliary arm reaches the pendular position while the counterweight is not yet in this position, the solenoid valve is automatically activated to add fluid into the balancing pipe and thus restore the balancing of the jib.

According to another embodiment of the invention with manual fluid inlet control, the fluid inlet control means consists of a manual hydraulic valve or control valve.

Advantageously, according to the invention, a hydraulic fluid outlet pipe leading to a reservoir is connected to the balancing pipe close to each of the two hydraulic jacks, an evacuation control valve being placed on each said outlet pipe. Thus, it can be understood that the operator can use one of these evacuation control valves to correct any synchronisation defect in the movements of the auxiliary arm and the counterweight due to excess fluid in the balancing pipe.

BRIEF DESCRIPTION OF THE DRAWINGS

Two preferred embodiments are described below as examples that are in no way limitative in order to facilitate understanding of the invention, with reference to the attached diagrammatic drawings in which.

DETAILED DESCRIPTION OF THE PREFERRED EMBODIMENT

Figure 1:
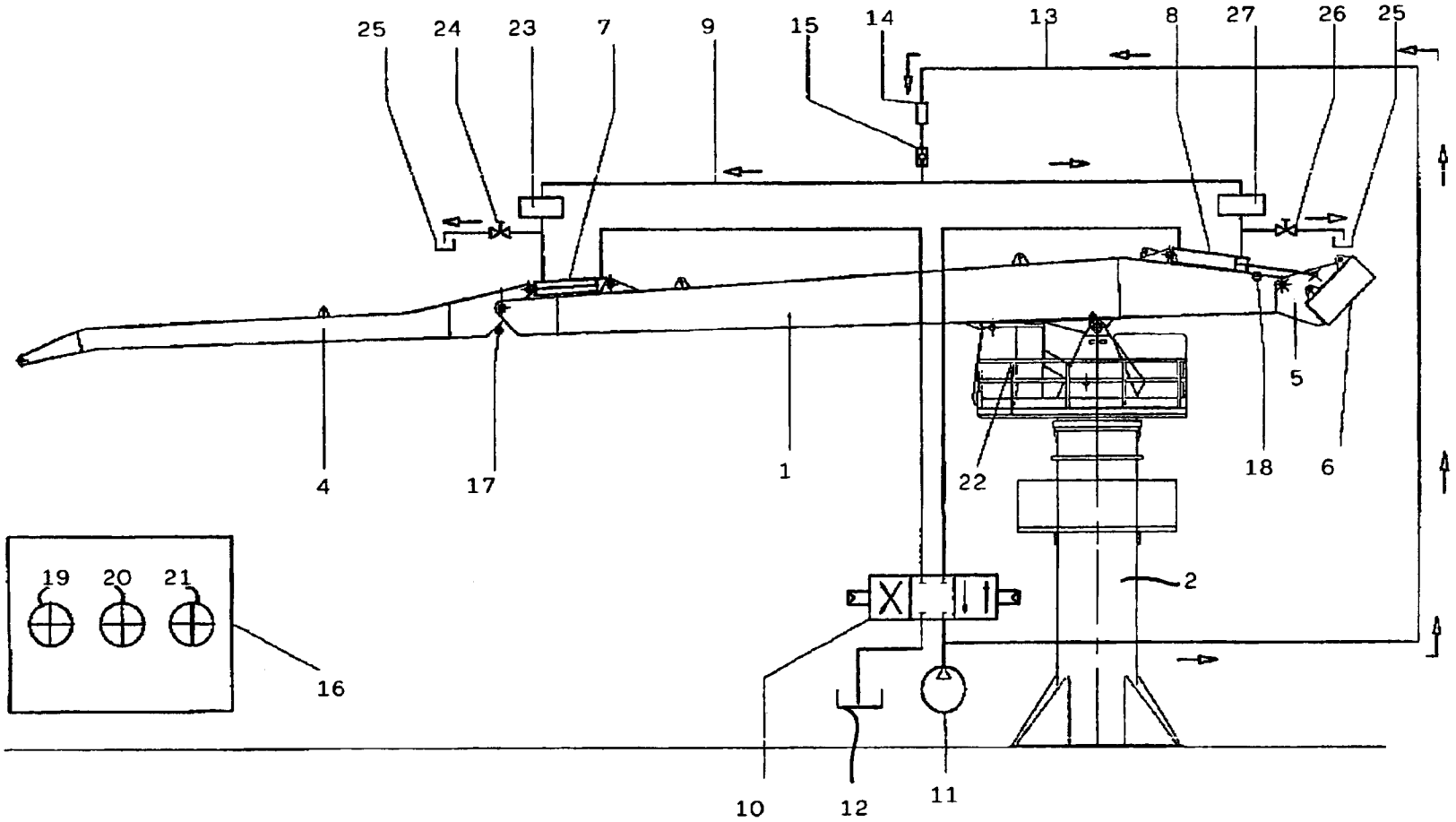
FIG. 1 is a side view of the jib of a crane with articulated arms and a hydraulic balancing device equipped with a system according to the invention for the automatic addition of fluid, the auxiliary arm being shown in the horizontal position.
Figure 2:
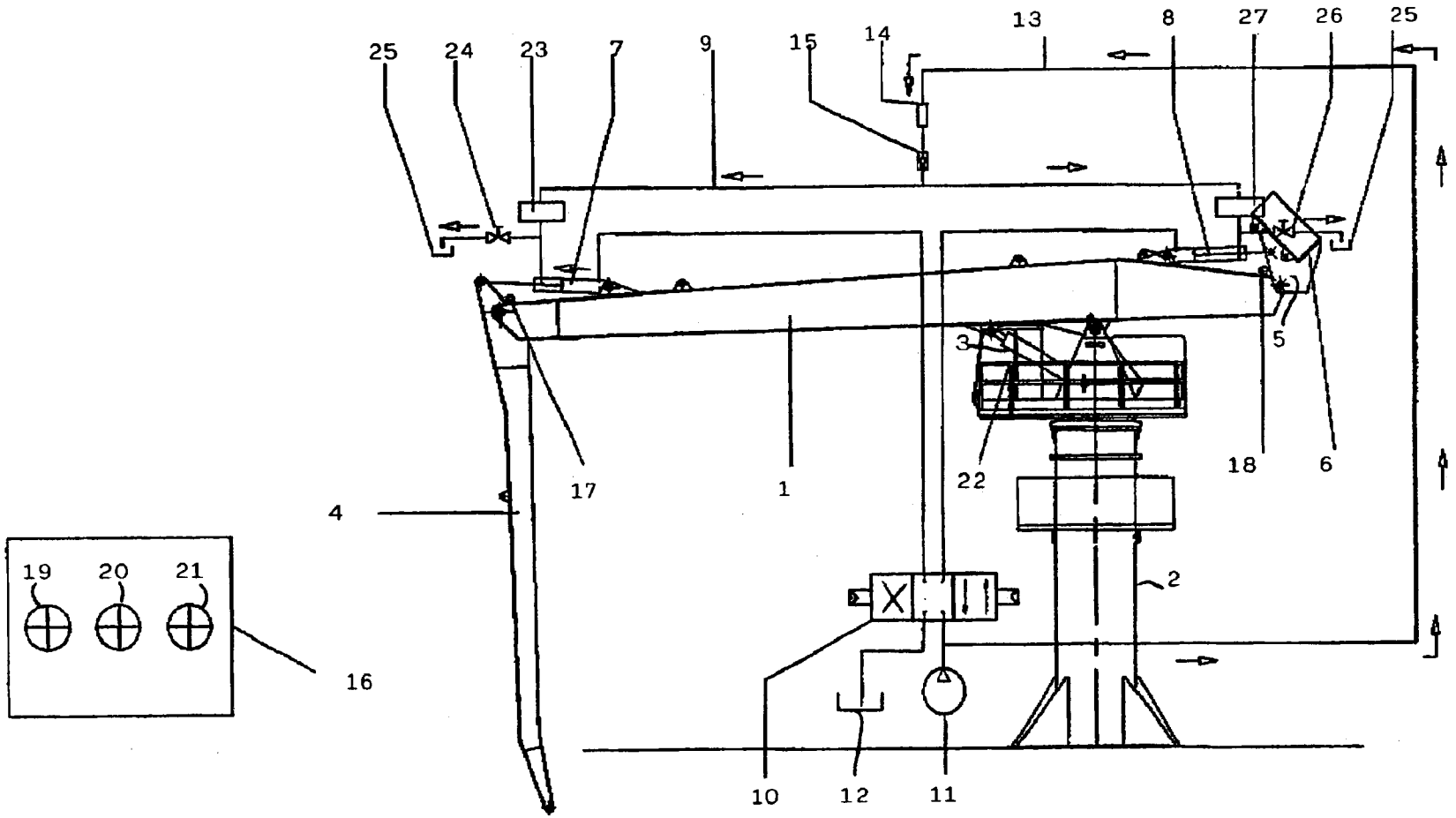
FIG. 2 is a view similar to FIG. 1, but with the auxiliary arm in the pendular position.

FIGS. 1 and 2 show the jib of a crane with articulated arms equipped with a hydraulic automatic balancing system as described in French patent published as number 2 536 733. The crane jib comprises a main arm 1 articulated to a turret 2 around a horizontal axis and which is tilted under the control of a jack 3. An auxiliary arm 4 is articulated at the front end of arm 1, and a balancing beam 5 fitted with a counterweight 6 is articulated at its rear end. A double acting hydraulic jack 7 is installed at the front end of the main arm 1 and its rod is attached to the auxiliary arm 4. Similarly, a double acting hydraulic jack 8 is installed at the rear end of the main arm 1, and its rod is attached to the balancing beam 5. The chamber of the jack 7 with an annular section is connected through a pipe 9, called the balancing pipe, to the chamber with an annular section of hydraulic jack 8, while the full section chambers of these two jacks are selectively connected through a hydraulic distributor 10 to a hydraulic fluid supply pump 11 and to a hydraulic fluid reservoir 12.

As explained in patent No. 2 536 733 mentioned above, if the operator would like to extend the span of the jib starting from the position shown in FIG. 2, he puts the distributor 10 into its right position in the view shown on this figure, such that the full section chamber of the jack 8 is supplied with fluid and, by displacement of the rod of this jack, simultaneously swings the balancing beam 5 with its counterweight 6, and due to the connection between the jacks 7 and 8, lifts the auxiliary arm 4. Since the value of the counterweight is calculated as a function of the self-weight of the elements of the jib and the lever arms, the jib is thus balanced at all times.

According to the invention, a hydraulic line 13 connects the pump 11 to the balancing pipe 9 through a solenoid valve 14 and a non-return valve 15. The solenoid valve 14 is controlled through a logic controller 16 by mechanical, hydraulic, electric or electronic type detectors 17, 18 installed on the auxiliary arm 4 and on the main arm 1 respectively.

Three control lights 19, 20 and 21 installed in the logic controller 16 manage the state of the solenoid valve 14, in other words a detection light 19 of the counterweight 6 that lights up when the detector 18 does not detect the presence of a counterweight and which goes off when the detector 18 detects the counterweight in the vertical position, a detection light 20 of the auxiliary arm 4 that goes off when the detector 17 detects the presence of the auxiliary arm and lights up when the auxiliary arm reaches its pendular position in which the detector 17 loses its detection and a light 21 showing activation of the solenoid valve 14 that comes on when the two lights 19, 20 are on at the same time.

In normal operating mode of the crane, when the jib is in the horizontal position (FIG. 1), the light 20 is off because the detector 17 detects the presence of the auxiliary arm 4, and the light 19 is on since the detector 18 does not detect the presence of the balancing beam 5. The light 21 is then off and therefore the solenoid valve 14 is not activated.

Similarly, when the auxiliary arm 4 reaches the pendular position (FIG. 2), in the same way as for the balancing beam 5, the detector 17 loses detection of the auxiliary arm 4 and the light 20 comes on, while at the same time the detector 18 detects the presence of the balancing beam 5 and the light 19 goes off, such that the light 21 remains off and therefore the solenoid valve 14 is not activated.

If, due to fluid leaks occurring in the hydraulic circuit during operation, the auxiliary arm 4 reaches its pendular position while the detector 18 does not detect the presence of the balancing beam 5, the detection light 20 of the auxiliary arm 4 lights up while the light 19 of the counterweight detector is still on. Simultaneous lighting of the two lights 19 and 20 makes the light 21 come on and automatically activates solenoid valve 14 that carries fluid through the line 13 into the balancing pipe 9 from the pump 11. This automatic fluid supply restores the balance, that causes automatic deactivation of the solenoid valve 14 and the crane returns to the normal operating mode.

According to this embodiment shown in FIGS. 1 and 2, it is also possible to activate the solenoid valve 14 in manual mode starting from a control device, for example a push button 22 located in the operator's cab.

Pressing on this push button 22 activates the solenoid valve 14 and fluid is inlet under pressure into the balancing pipe 9. This operation and control of the extension of the auxiliary arm 4 through the distributor 10 bring the jig onto its stops in the extended position, and the crane once again operates in normal operating mode.

It will be noted that the non-return valve 15 placed on the fluid supply line 13 between the solenoid valve 14 and the balancing pipe 9 prevents any accidental return of the balancing pressure.

A hydraulic valve 24 is located at one end of the balancing pipe 9 between a hydraulic valve 23 and the annular jack chamber 7, and actuation of this hydraulic valve evacuates any excess fluid in the pipe 9 towards a reservoir 25. Similarly, a hydraulic valve 26 allowing fluid to flow into the reservoir 25 is placed between the annular chamber of the jack 8 and the hydraulic valve 27 located on the pipe 9.

Figure 3:
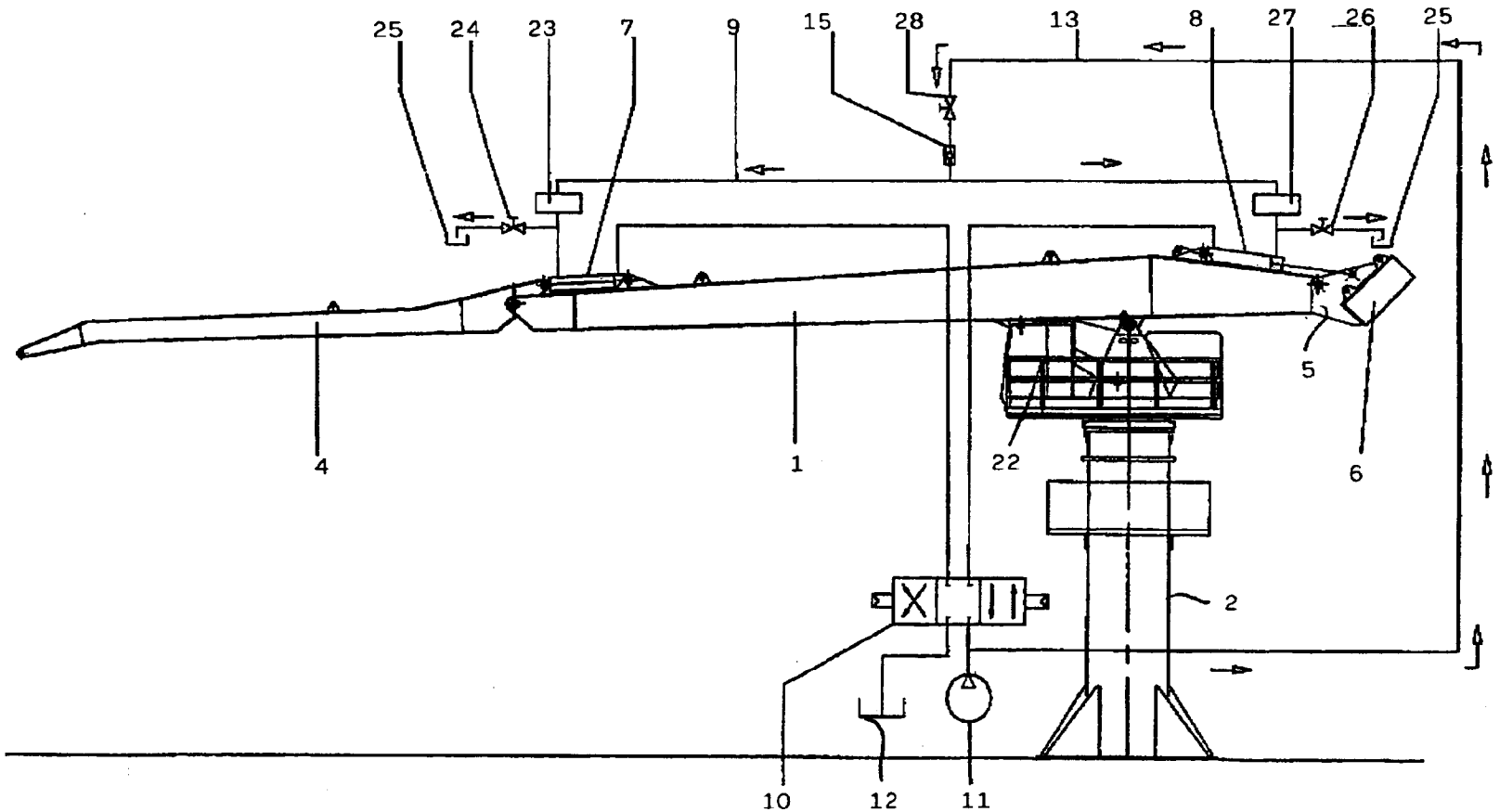
FIG. 3 is a side view of a jib of a crane with articulated arms and an automatic hydraulic balancing device, equipped with a system for manual input of fluid according to the invention.

FIG. 3 shows a manually controlled embodiment of the fluid inlet device according to the invention. In this embodiment, the same figures are used to denote the same elements as those belonging to the embodiments shown in FIGS. 1 and 2.

This embodiment includes the fluid supply line 13 that supplies fluid to the balancing pipe 9 through the non-return valve 15. A hydraulic valve 28 is located on the line 13 on the inlet side of the non-return valve 15, which provides manual control over fluid added into the balancing pipe 9.

There are also the hydraulic valves 24, 26 that allow any excess fluid in the balancing pipe 9 to be evacuated into the reservoir 25.

When the operator observes a lack of synchronisation of the auxiliary arm 4 and the balancing beam 5 of the counterweight 6, in other words when the auxiliary arm is not at the extended stop while the balancing beam 5 reaches its outer stops (which means lack of fluid in the pipe 9), he opens the hydraulic valve 28 while actuating the distributor 10 to control extension of the auxiliary arm 4 (distributor in its right position when looking at FIG. 3).

The hydraulic pressure in the system then lifts the auxiliary arm 4 until it reaches its extended stop (position in FIG. 3). When this balancing position is obtained, the operator closes the hydraulic valve 28 and the crane is once again in its working configuration.

However, if the operator observes a lack of synchronisation in the movements of the auxiliary arm 4 and the balancing beam 5 of the counterweight, such that the arm 4 reaches its extended stop while the balancing beam 5 has not reached its outer stops (which denotes excess fluid in the balancing pipe 9), he positions the jib of the crane in the high position and opens the valve 26 so as to allow excess fluid in the pipe 9 to be evacuated to the reservoir 25 until the balancing beam 5 reaches its outer stops by gravity. The valve 26 also controls the balancing beam 5 dropping onto its stops.

Once this balanced position is obtained, the operator closes the valve 26 and the crane is once again in the working configuration.

It will be understood that the above description has been given simply as an example without being limitative, and that constructive additions or modifications could be made to it without going outside the scope of this invention.

What I claim is:

1. A crane jib which comprises:

a main arm installed free to rotate about a support turret, an auxiliary arm articulated at a first end of the main arm, a first double acting hydraulic jack having a cylinder supported on said main arm and a rod which is connected to said auxiliary arm, to control a tilting of said auxiliary arm with relation to said main arm, a counterweight articulated at a second end of said main arm, a second double acting hydraulic jack having a cylinder supported by said main arm and a rod connected to said counterweight, a hydraulic balancing pipe connecting an annular chamber of said first double acting hydraulic jack to an annular chamber of said second double acting hydraulic jack, a control means selectively connecting a full section chamber of one of said first double acting hydraulic jack and said second double acting hydraulic jack to a hydraulic fluid supply source and a full section chamber of the other of said first double acting hydraulic jack and said second double acting hydraulic jack to a hydraulic fluid reservoir, a hydraulic fluid transfer line connecting said hydraulic fluid supply source to said hydraulic balancing pipe, means for controlling hydraulic fluid transfer to said hydraulic balancing pipe, provided on said hydraulic fluid transfer line, first position detection means provided close to the articulated connection between the main arm and the auxiliary arm, for detecting a position of the auxiliary arm with relation to the main arm, second position detection means provided close to the articulated connection between the main arm and the counterweight, for detecting a position of the counterweight with relation to the main arm, and a logic controller connected firstly to said first and second position detection means and secondly to said means for controlling hydraulic fluid transfer, said logic controller activating said means for controlling hydraulic fluid transfer to provide a hydraulic fluid transfer to said hydraulic balancing pipe when said first position detection means detects a pendular position of said auxiliary arm while said second position detection means does not detect a vertical position of the counterweight.

2. Crane jib according to claim 1, wherein said means for controlling hydraulic fluid transfer comprises a solenoid valve.

3. Crane jib according to claim 2, wherein said first position detection means, when detecting a pendular position of said auxiliary arm, controls through said logic controller a deactivation of said solenoid valve and a cutting off of a supply of hydraulic fluid to said hydraulic balancing pipe.

4. Crane jib, according to claim 2, wherein a manual control is provided in an operator's cab of the crane to activate said solenoid valve.

5. Crane jib, according to claim 1, wherein said means for controlling hydraulic fluid transfer consists of a hydraulic valve.

6. Crane jib according to claim 1, wherein said means for controlling hydraulic fluid transfer consists of a manual control valve.

7. Crane jib, according to claim 1, wherein a non-return valve is provided on the hydraulic fluid transfer line, on an inlet side of said control means.

8. Crane jib, according to claim 1, wherein an evacuation pipe is connected to the hydraulic balancing pipe, close to each of said first and second double acting hydraulic jacks, to evacuate excess fluid towards a reservoir and an evacuation control valve is fitted on each of said evacuation pipes.

9. Crane jib, according to claim 8, wherein a hydraulic safety valve is provided on the hydraulic fluid transfer line, on an inlet side of a connection of this hydraulic fluid transfer line with each of the two evacuation pipes.

* * * * *